US010953458B2

(12) United States Patent
Xue et al.

(10) Patent No.: US 10,953,458 B2
(45) Date of Patent: Mar. 23, 2021

(54) WHEEL ROLLING DEVICE

(71) Applicant: CITIC Dicastal CO., LTD, Qinhuangdao (CN)

(72) Inventors: Bowen Xue, Qinhuangdao (CN); Xueqiang Li, Qinhuangdao (CN); Baojun Cui, Qinhuangdao (CN); Jiandong Guo, Qinhuangdao (CN)

(73) Assignee: CITIC DICASTAL CO., LTD, Hebei (CN)

( * ) Notice: Subject to any disclaimer, the term of this patent is extended or adjusted under 35 U.S.C. 154(b) by 175 days.

(21) Appl. No.: 16/384,247

(22) Filed: Apr. 15, 2019

(65) Prior Publication Data

US 2020/0001348 A1 Jan. 2, 2020

(30) Foreign Application Priority Data

Jul. 2, 2018 (CN) ..... 201810704599.5

(51) Int. Cl.
*B21H 1/04* (2006.01)
*B21D 53/26* (2006.01)
*B21D 22/14* (2006.01)

(52) U.S. Cl.
CPC ..... *B21H 1/04* (2013.01); *B21D 22/14* (2013.01); *B21D 53/26* (2013.01)

(58) Field of Classification Search
CPC .... B21D 53/26; B21D 53/262; B21D 53/264; B21D 53/30; B21D 22/14; B21D 22/18; B21K 1/28; B21K 1/38
USPC ..... 101/3.1, 5, 6, 22, 23; 29/894
See application file for complete search history.

(56) References Cited

U.S. PATENT DOCUMENTS

2009/0293688 A1* 12/2009 Nillies ..... B21D 22/18 82/129
2009/0301153 A1* 12/2009 Tachi ..... B21D 53/30 72/82
2017/0182543 A1* 6/2017 Xue ..... B21D 53/264
2017/0182614 A1* 6/2017 Xue ..... B24B 41/00
2017/0182615 A1* 6/2017 Xue ..... B24B 47/12
2017/0182616 A1* 6/2017 Xue ..... B24B 9/04
2017/0182617 A1* 6/2017 Xue ..... B24D 13/145
2017/0182618 A1* 6/2017 Xue ..... B24B 9/04
2017/0182619 A1* 6/2017 Xue ..... B24B 9/04
2017/0182620 A1* 6/2017 Xue ..... B24B 9/04
2017/0182761 A1* 6/2017 Xue ..... B44B 3/04

* cited by examiner

*Primary Examiner* — Adam J Eiseman
*Assistant Examiner* — Bobby Yeonjin Kim
(74) *Attorney, Agent, or Firm* — Calfee, Halter & Griswold LLP

(57) ABSTRACT

The present application relates to a wheel rolling device, which is composed of a lower lifting rotating system, first rolling systems, a synchronous clamping drive system, a second rolling system and a third rolling system. The present application may not only strengthen the center hole, the inner and outer rims, the upper and lower rims, the flange root and the like portion of the wheel by rolling, but also may strengthen the bolt holes and valve holes of the wheel by extrusion; at the same time, the present application has the characteristics of high automation, powerful function, advanced technology, strong versatility and safe and stable performance.

1 Claim, 4 Drawing Sheets

WHEEL ROLLING DEVICE

CROSS-REFERENCE TO RELATED APPLICATIONS

This application claims priority to Chinese Patent Application No. 201810704599.5 filed on Jul. 2, 2018, which is hereby incorporated by reference in its entirety.

TECHNICAL FIELD

The application relates to a rolling device, in particular to a wheel rolling device.

BACKGROUND ART

As the automotive industry continues to pursue lightweight, especially in the wheel industry, the lightweight of wheels directly affects the fuel economy of automobiles. Some automobile factories not only require the wheels to be lightweight, but also have strict standards for the appearances and structures of the wheels. Lightweight tends to reduce the bending and the radial fatigue lives of the wheels.

SUMMARY OF THE INVENTION

The object of the present application is to provide a wheel rolling device, which may not only strengthen the center hole, the inner and outer rims, the upper and lower rims, the flange root and the like portion of the wheel by rolling, but also may strengthen the bolt holes and valve holes of the wheel by extrusion.

In order to achieve the above object, the technical solution of the present application is as follows: Wheel rolling device, includes a frame, lifting cylinders, a first servo motor, a lower fixing plate, a lower lifting plate, supporting rollers, a rotating plate, a first guiding rail, a left bottom plate, a left vertical plate, a first rack, a second guiding rail, a first gear, a left vertical sliding plate, a second servo motor, a first servo electric cylinder, a second servo electric cylinder, a third guiding rail, a sliding block, a left transverse sliding plate, a connecting rod, a overturning plate, a third servo electric cylinder, a fourth guiding rail, an oblique sliding plate, a third servo motor, a left bracket, a first shaft, a first bearing seat, a first bevel gear, a second bevel gear, a transition block, a second bearing seat, a second shaft, a first roller, a second roller, a third shaft, a third bearing seat, a pin shaft, a transition plate, a fifth guiding rail, a fourth servo motor, a right sliding frame, a second rack, a second gear, a right vertical plate, a right bottom plate, a sixth guiding rail, a fifth servo motor, a sixth servo motor, a fourth servo electric cylinder, an upper fixing plate, a third gear, third racks, a seventh guiding rail, a left sliding plate, left shafts, left bearing seats, V-type rollers, right shafts, right bearing seats, a right sliding plate, a clamping cylinder, a seventh servo motor, a fifth servo electric cylinder, an eighth guiding rail, a sixth servo electric cylinder, a fourth bearing seat, a fourth shaft, an eighth servo motor, an upper sliding frame, a ninth guiding rail, a fourth rack, an upper vertical plate, a fourth gear, an upper sliding plate, a ninth servo motor, an upper extrusion cutter, a fifth shaft, a fifth bearing seat, a tenth servo motor, a rotating frame, a eleventh servo motor, a sixth bearing seat, a sixth shaft, a lower extrusion cutter, guiding pillars and guiding sleeves, etc.

Lower lifting rotating system includes that: two of the lifting cylinders and four of the guiding sleeves are fixed on the lower fixing plate; output end of the lifting cylinder is hinged with lower part of the lower lifting plate; four of the guiding pillars matched with the guiding sleeves are also fixed below the lower lifting plate; the first servo motor is fixed below the lower lifting plate, and output end thereof is connected with the rotating plate; the supporting rollers are uniformly mounted in circumferential direction below the rotating plate; the first servo electric cylinder is fixed on left side above the rotating plate; the left bottom plate is fixed on left side above the rotating plate through the first guiding rail; output end of the first servo electric cylinder is connected with the left bottom plate; the fourth servo electric cylinder is fixed on right side above the rotating plate; the right bottom plate is fixed on right side above the rotating plate through the sixth guiding rail; and output end of the fourth servo electric cylinder is connected with the right bottom plate.

First rolling system includes that: the left vertical plate is fixed above the left bottom plate; the left vertical sliding plate is fixed on left side of the left vertical plate through the second guiding rail; the first rack is fixed on left side of the left vertical plate; the second servo motor is fixed on left side of the left vertical sliding plate, and output end thereof is fixed with the first gear; the first gear engages with the first rack; the left transverse sliding plate is fixed above the left vertical sliding plate; the sliding block is mounted above the left transverse sliding plate through the third guiding rail; the second servo electric cylinder is fixed on right side of the left transverse sliding plate, and output end thereof is connected with right side of the sliding block; lower part of the overturning plate is hinged with left side of the left transverse sliding plate; two ends of the connecting rod are hinged with the overturning plate and the sliding block, respectively; the oblique sliding plate is fixed above the overturning plate through the fourth guiding rail; the third servo electric cylinder is fixed above the overturning plate, output end thereof is connected with the oblique sliding plate; the left bracket is fixed above the oblique sliding plate; the first bearing seat is fixed above the left bracket; the first shaft is mounted inside the first bearing seat through a bearing; the third servo motor is fixed below the left bracket, and output end thereof is connected with lower part of the first shaft; the transition block is fixed above the first bearing seat; and the second bearing seat is fixed above the transition block; the second shaft is mounted inside the second bearing seat through a bearing; the first roller is fixed above the second shaft, and the second bevel gear is fixed below the second shaft; and the second bevel gear is meshed with the first bevel gear. The present device includes two sets of first rolling system which are positioned above and below respectively.

Second rolling system includes that: the right vertical plate is fixed above the right bottom plate; the right sliding frame is fixed on right side of the right vertical plate through the fifth guiding rail; the second rack is fixed on right side of the right vertical plate; the sixth servo motor is fixed below the right sliding frame, and output end thereof is fixed with the second gear; the second gear is meshed with the second rack; the third bearing seat is fixed inside the right sliding frame through the pin shaft; the third shaft is mounted inside the third bearing seat through a bearing; the fifth servo motor is fixed on right side of the right sliding frame, and output end thereof is connected with right side of the pin shaft; the fourth servo motor is fixed below the third bearing seat through the transition plate, and output end thereof is connected with lower end of the third shaft; and the second roller is fixed on the top of third shaft.

Synchronous clamping drive system includes that: the third gear is fixed above the upper fixing plate; the left sliding plate is fixed above the upper fixing plate through the seventh guiding rail; the two left bearing seats are fixed above the left sliding plate; each of the two left shafts is fixed inside one of the left bearing seats through a bearing; the right sliding plate is mounted above the upper fixing plate through the seventh guiding rail; the two right bearing seats are fixed above the right sliding plate; each of the two right shafts is mounted inside one of the right bearing seats through a bearing; upper part of the two left shafts and upper part of the two right shafts are fixed with V-type rollers respectively; the seventh servo motor is fixed below the right sliding plate, and output end thereof is hinged with lower part of one of the right shafts; the clamping cylinder is fixed on right side of the frame, and output end thereof is connected with the right sliding plate; and lower parts of the left sliding plate and right sliding plate are respectively fixed with one of the third racks respectively, and two of the third racks are meshed with the third gear at the same time.

The first rolling system is mounted below left side of the frame through the eighth guiding rail; and the fifth servo electric cylinder is fixed on upper part of left side of the frame, and output end thereof is connected with the first rolling system.

Third rolling system includes that: the upper sliding plate is mounted below right side of the frame through eighth guiding rail; the sixth servo electric cylinder is fixed on upper part of right side of the frame, and output end thereof is connected with the upper sliding plate; the upper vertical plate is fixed below the upper sliding plate; the upper sliding frame is fixed on right side of the upper vertical plate through the ninth guiding rail; the fourth rack is also fixed on right side of the upper vertical plate; the ninth servo motor is fixed above the upper sliding frame, and output end thereof is fixed with the fourth gear; the fourth gear is meshed with the fourth rack; the fourth bearing seat is fixed on right side of the upper sliding frame; the fourth shaft is mounted inside the fourth bearing seat through a bearing; the eighth servo motor is fixed inside the empty slot on right side of the upper sliding frame and placed on left side of the fourth bearing seat, and output end thereof is connected with left side of the fourth shaft; the rotating frame is fixed on right side of the fourth bearing seat; the fifth bearing seat fixed above the rotating frame; the fifth shaft is fixed inside the fifth bearing seat through a bearing; the upper extrusion cutter is fixed above the fifth shaft; the tenth servo motor is fixed on lower end of upper part of the rotating frame, and output end thereof is connected with lower part of fifth shaft; the sixth bearing seat is fixed on lower part of the rotating frame; the sixth shaft is fixed inside the sixth bearing seat through a bearing; the lower extrusion cutter is fixed below the sixth shaft, and the eleventh servo motor is fixed on the upper end of lower part of the rotating frame, and output end thereof is connected with upper part of the sixth shaft.

During operation, the clamping cylinder makes the four V-type rollers synchronously clamp the wheel through the third gear, the third rack and the seventh guiding rail; the seventh servo motor makes the clamped wheel rotate; the second servo electric cylinder regulates the overturning plate and the first roller to an appropriate angle through the third guiding rail and the connecting rod; the third servo motor drives the first bevel gear to rotate through the first shaft; the first bevel gear drives the second shaft and the first roller to rotate by meshing with the second bevel gear; the lifting cylinder initially lifts the first roller to a certain height through the guiding pillars and the guiding sleeves; the second servo motor drives the first gear to rotate, and accurately regulate the height of first roller by meshing with the first rack; the first servo electric cylinder may regulate the horizontal position of the first roller through the first guiding rail; the third servo electric cylinder makes the first roller exert rolling pressure on rolled part through the fourth guiding rail; the first roller may roll lower part of central hole, back cavity of spoke and inner rim of the wheel; at the same time, the first rolling system above may roll upper part of the central hole, upper rim and the like part of the wheel.

The sixth servo motor regulates the second roller to the appropriate height through the second gear, the second rack and the fifth guiding rail; the fourth servo motor cylinder regulates the horizontal position of the second roller through the sixth guiding rail; the fourth servo motor drives the second roller to rotate through the third shaft; the fifth servo motor arbitrarily regulates the angle of second roller through the pin shaft; and the second roller may achieve rolling on outer rim of the wheel.

The first servo motor may make the first roller and the second roller rotate and exchange position through the supporting roller and the rotating plate; the lower rim of the wheel may be rolled by regulating the first roller; the second roller may roll flange root of the wheel.

The ninth servo motor regulates the lower extrusion cutter to an appropriate position through the fourth gear, the fourth rack and the ninth guiding rail; with the rotation of the wheel, each bolt hole of the wheel may be extruded; the eighth servo motor makes the rotating frame rotate by a certain angle through fourth shaft, so that the axis of the upper extrusion cutter is coaxial with the axis of the valve hole of the wheel; and by regulating the position of the upper extrusion cutter, the valve hole of the wheel may be extruded.

In use, the present application may not only strengthen the center hole, the inner and outer rims, the upper and lower rims, the flange root and the like portion of the wheel by rolling, but also may strengthen the bolt holes and valve holes of the wheel by extrusion; at the same time, the present application has the characteristics of high automation, powerful function, advanced technology, strong versatility and safe and stable performance.

Figure 1:
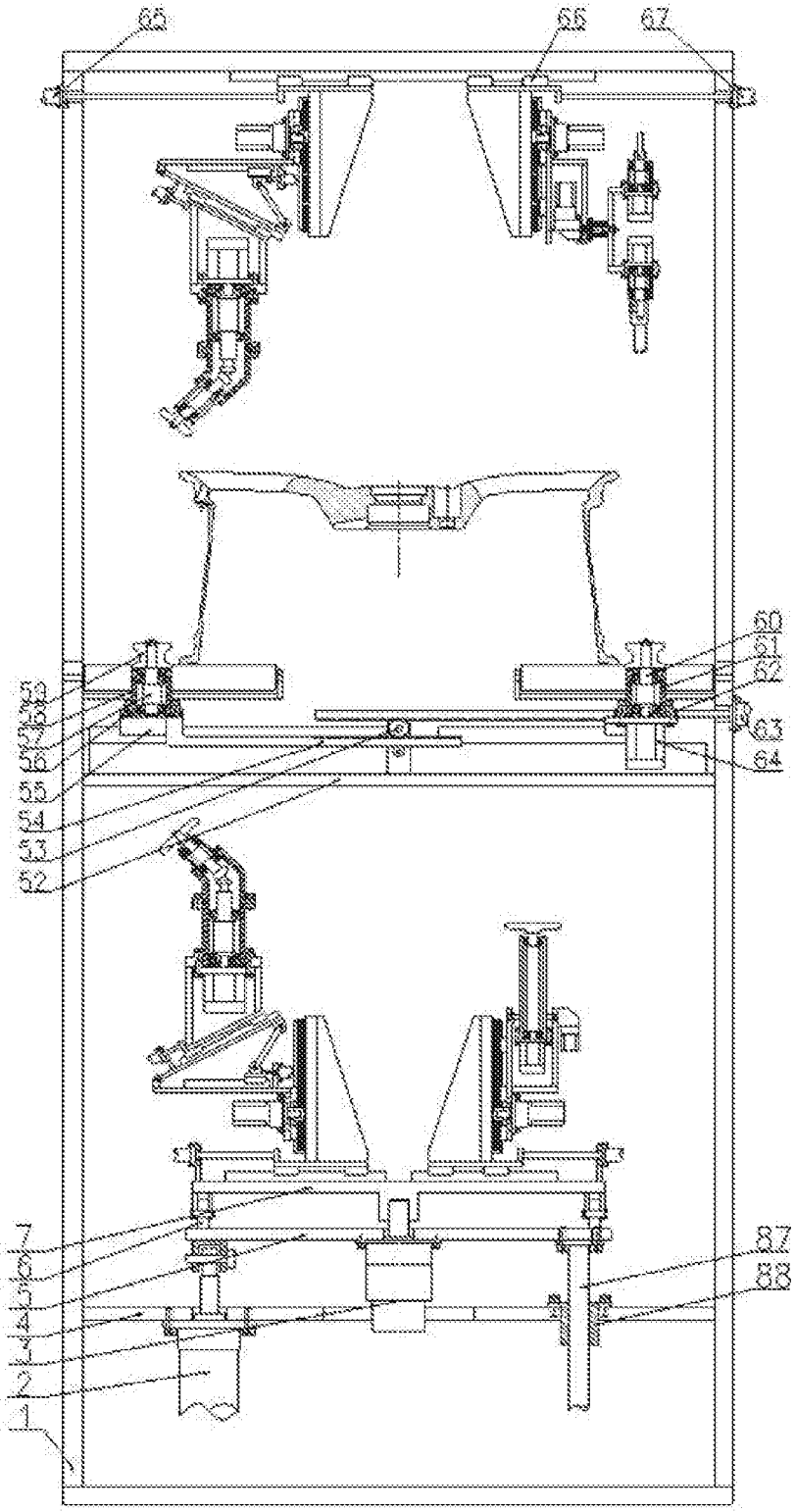
FIG. 1 is the front view of the wheel rolling device of the present application.
Figure 2:
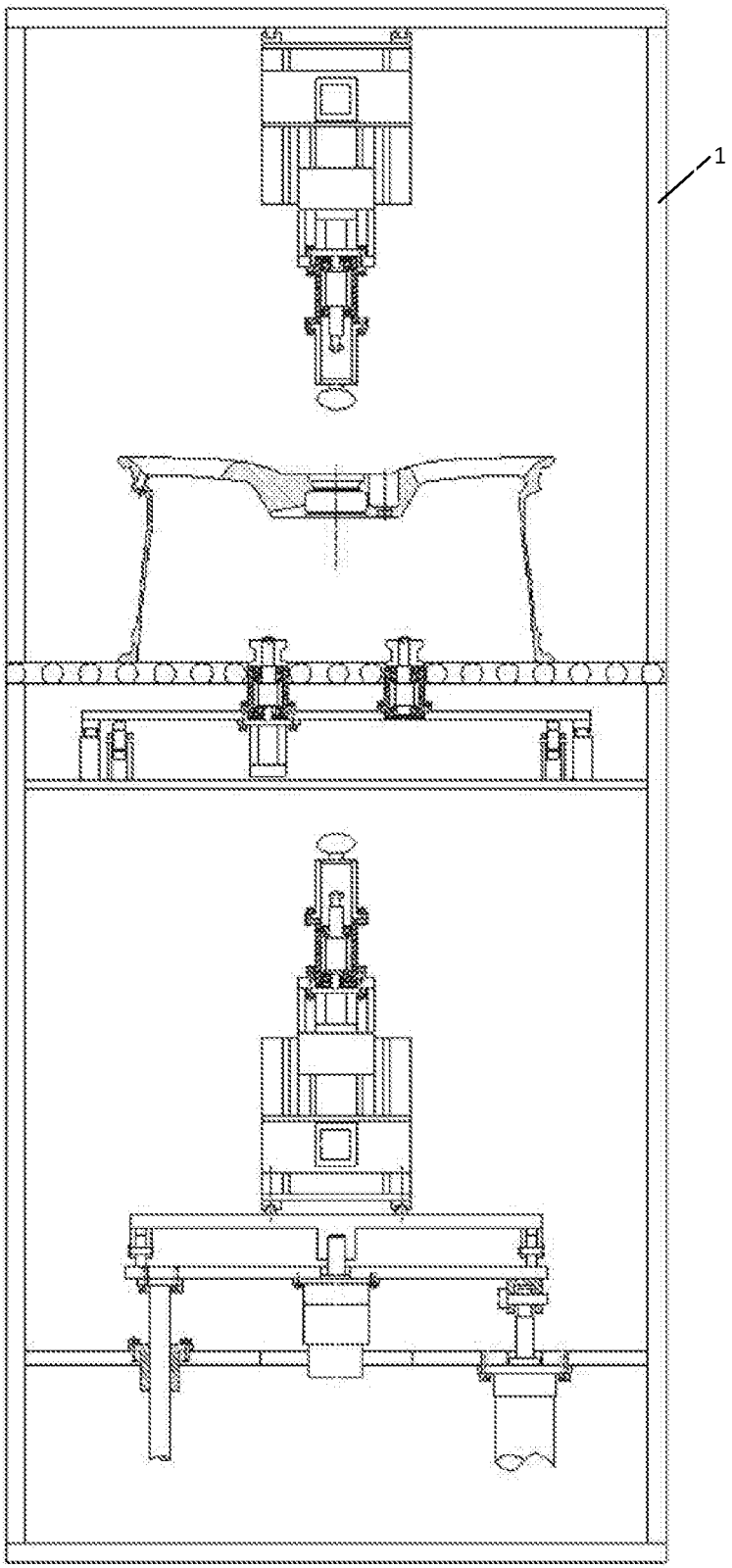
FIG. 2 is the left view of a wheel rolling device of the present application.
Figure 3:
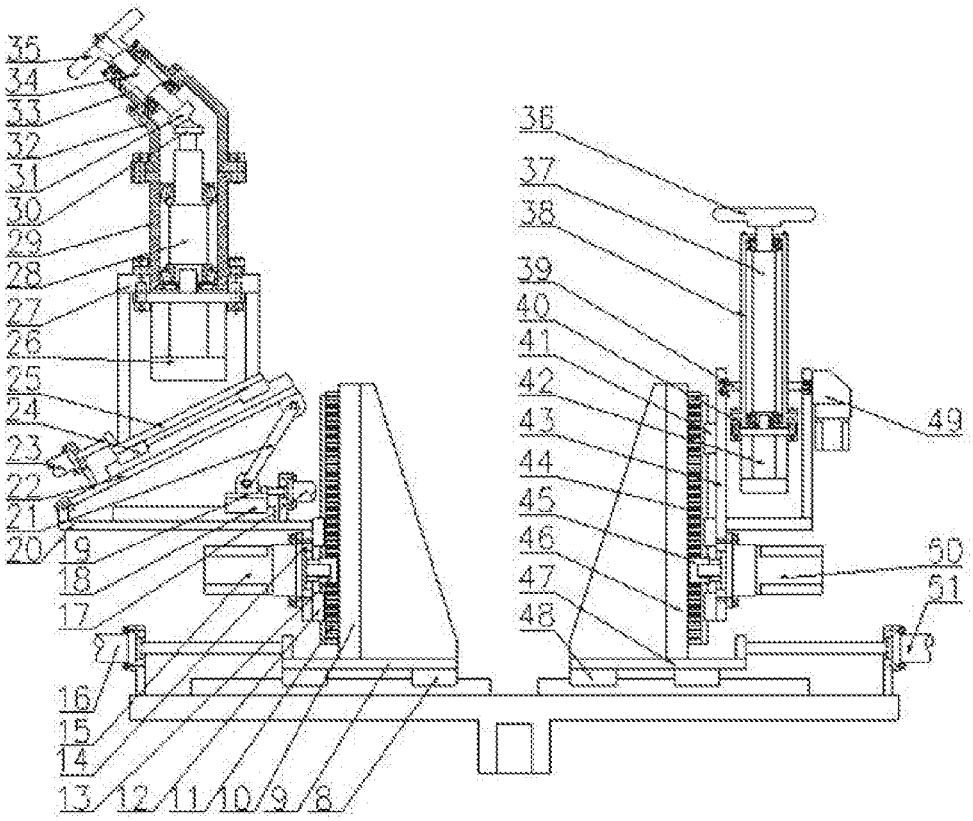
FIG. 3 is the front view of the first rolling system and the second rolling system of the wheel rolling device of the present application.
Figure 4:
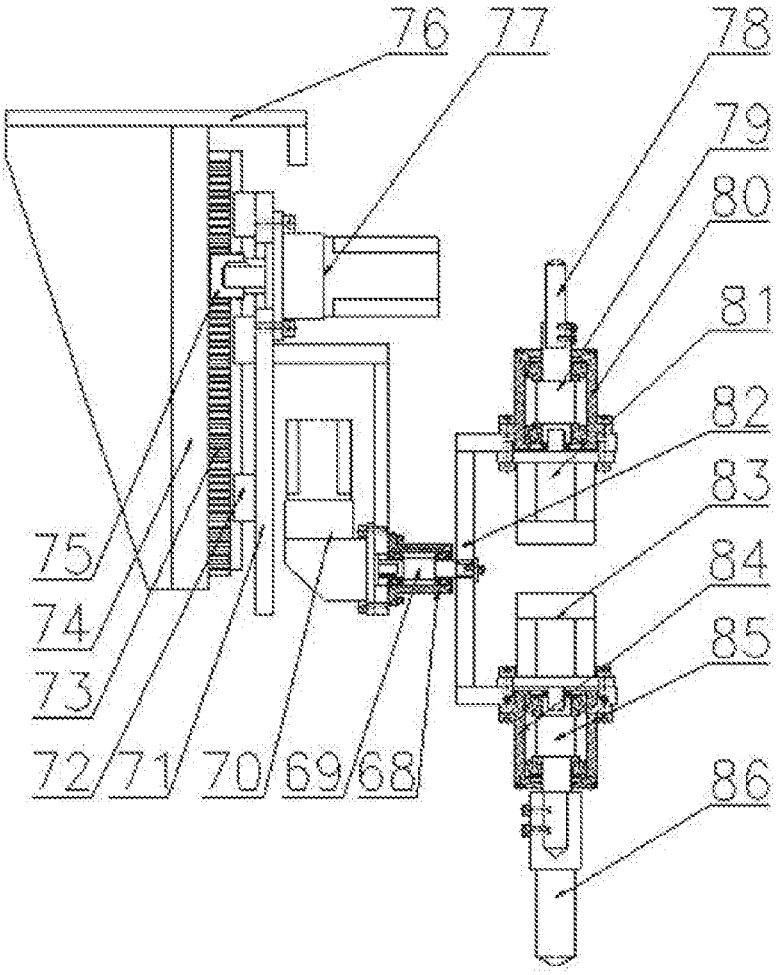
FIG. 4 is the front view of the third rolling system of the wheel rolling device of the present application.

In which, 1-frame, 2-lifting cylinder, 3-first servo motor, 4-lower fixing plate, 5-lower lifting plate, 6-supporting roller, 7-rotating plate, 8-first guiding rail, 9-left bottom plate, 10-left vertical plate, 11-first rack, 12-second guiding rail, 13-first gear, 14-left vertical sliding plate, 15-second servo motor, 16-first servo electric cylinder, 17-second servo electric cylinder, 18-third guiding rail, 19-sliding block, 20-left transverse sliding plate, 21-connecting rod, 22-overturning plate, 23-third servo electric cylinder, 24-fourth guiding rail, 25-oblique sliding plate, 26-third servo motor, 27-left bracket, 28-first shaft, 29-first bearing seat, 30-first bevel gear, 31-second bevel gear, 32-transition block, 33-second bearing seat, 34-second shaft, 35-first roller, 36-second roller, 37-third shaft, 38-third bearing seat, 39-pin shaft, 40-transition plate, 41-fifth guiding rail, 42-fourth servo motor, 43-right sliding frame, 44-second rack, 45-second gear, 46-right vertical plate, 47-right bottom plate, 48-sixth guiding rail, 49-fifth servo motor, 50-sixth servo motor, 51-fourth servo electric cylinder, 52-upper fixing plate, 53-third gear, 54-third rack, 55-seventh guiding rail, 56-left sliding plate, 57-left shaft, 58-left bearing seat, 59-V type roller, 60-right shaft, 61-right bearing seat, 62-right sliding plate, 63-clamping cylinder, 64-seventh servo motor, 65-fifth servo electric cylinder, 66-eighth guiding rail, 67-sixth servo electric cylinder, 68-fourth bearing seat, 69-fourth shaft, 70-eighth servo motor, 71-upper sliding frame, 72-ninth guiding rail, 73-fourth rack, 74-upper vertical plate, 75-fourth gear, 76-upper sliding plate, 77-ninth servo motor, 78-upper extrusion cutter, 79-fifth shaft, 80-fifth bearing seat, 81-tenth servo motor, 82-rotating frame, 83-eleventh servo motor, 84-sixth bearing seat, 85-sixth shaft, 86-lower extrusion cutter, pillar, 87-guiding pillar, 88-guiding sleeve.

DETAILED DESCRIPTION OF THE INVENTION

The details and operation conditions of the specific device of the present application are given below in conjunction with the illustration of the accompanying drawings.

The device includes a frame 1, lifting cylinders 2, a first servo motor 3, a lower fixing plate 4, a lower lifting plate 5, supporting rollers 6, a rotating plate 7, a first guiding rail 8, a left bottom plate 9, a left vertical plate 10, a first rack 11, a second guiding rail 12, a first gear 13, a left vertical sliding plate 14, a second servo motor 15, a first servo electric cylinder 16, a second servo electric cylinder 17, a third guiding rail 18, a sliding block 19, a left transverse sliding plate 20, a connecting rod 21, a overturning plate 22, a third servo electric cylinder 23, a fourth guiding rail 24, an oblique sliding plate 25, a third servo motor 26, a left bracket 27, a first shaft 28, a first bearing seat 29, a first bevel gear 30, a second bevel gear 31, a transition block 32, a second bearing seat 33, a second shaft 34, a first roller 35, a second roller 36, a third shaft 37, a third bearing seat 38, a pin shaft 39, a transition plate 40, a fifth guiding rail 41, a fourth servo motor 42, a right sliding frame 43, a second rack 44, a second gear 45, a right vertical plate 46, a right bottom plate 47, a sixth guiding rail 48, a fifth servo motor 49, a sixth servo motor 50, a fourth servo electric cylinder 51, an upper fixing plate 52, a third gear 53, third racks 54, a seventh guiding rail 55, a left sliding plate 56, left shafts 57, left bearing seats 58, V-type rollers 59, right shafts 60, right bearing seats 61, a right sliding plate 62, a clamping cylinder 63, a seventh servo motor 64, a fifth servo electric cylinder 65, an eighth guiding rail 66, a sixth servo electric cylinder 67, a fourth bearing seat 68, a fourth shaft 69, an eighth servo motor 70, an upper sliding frame 71, a ninth guiding rail 72, a fourth rack 73, an upper vertical plate 74, a fourth gear 75, an upper sliding plate 76, a ninth servo motor 77, an upper extrusion cutter 78, a fifth shaft 79, a fifth bearing seat 80, a tenth servo motor 81, a rotating frame 82, a eleventh servo motor 83, a sixth bearing seat 84, a sixth shaft 85, a lower extrusion cutter 86, guiding pillars 87 and guiding sleeves 88, etc.

Lower lifting rotating system includes that: two of the lifting cylinders 2 and four of the guiding sleeves 88 are fixed on the lower fixing plate 4; output end of the lifting cylinder 2 is hinged with lower part of the lower lifting plate 5; four of the guiding pillars 87 matched with the guiding sleeves 88 are also fixed below the lower lifting plate 5; the first servo motor 3 is fixed below the lower lifting plate 5, and output end thereof is connected with the rotating plate 7; the supporting rollers 6 are uniformly mounted in circumferential direction below the rotating plate 7; the first servo electric cylinder 16 is fixed on left side above the rotating plate 7; the left bottom plate 9 is fixed on left side above the rotating plate 7 through the first guiding rail 8; output end of the first servo electric cylinder 16 is connected with the left bottom plate 9; the fourth servo electric cylinder 51 is fixed on right side above the rotating plate 7; the right bottom plate 47 is fixed on right side above the rotating plate 7 through the sixth guiding rail 48; and output end of the fourth servo electric cylinder 51 is connected with the right bottom plate 47.

First rolling system includes that: the left vertical plate 10 is fixed above the left bottom plate 9; the left vertical sliding plate 14 is fixed on left side of the left vertical plate 10 through the second guiding rail 12; the first rack 11 is fixed on left side of the left vertical plate 10; the second servo motor 15 is fixed on left side of the left vertical sliding plate 14, and output end thereof is fixed with the first gear 13; the first gear 13 engages with the first rack 11; the left transverse sliding plate 20 is fixed above the left vertical sliding plate 14; the sliding block 19 is mounted above the left transverse sliding plate 20 through the third guiding rail 18; the second servo electric cylinder 17 is fixed on right side of the left transverse sliding plate 20, and output end thereof is connected with right side of the sliding block 19; lower part of the overturning plate 22 is hinged with left side of the left transverse sliding plate 20; two ends of the connecting rod 21 are hinged with the overturning plate 22 and the sliding block 19, respectively; the oblique sliding plate 25 is fixed above the overturning plate 22 through the fourth guiding rail 24; the third servo electric cylinder 23 is fixed above the overturning plate 22, output end thereof is connected with the oblique sliding plate 25; the left bracket 27 is fixed above the oblique sliding plate 25; the first bearing seat 29 is fixed above the left bracket 27; the first shaft 28 is mounted inside the first bearing seat 29 through a bearing; the third servo motor 26 is fixed below the left bracket 27, and output end thereof is connected with lower part of the first shaft 28; the transition block 32 is fixed above the first bearing seat 29; and the second bearing seat 33 is fixed above the transition block 32; the second shaft 34 is mounted inside the second bearing seat 33 through a bearing; the first roller 35 is fixed above the second shaft 34, and the second bevel gear 31 is fixed below the second shaft 34; and the second bevel gear 31 is meshed with the first bevel gear 30. The present device includes two sets of first rolling system which are positioned above and below respectively.

Second rolling system includes that: the right vertical plate 46 is fixed above the right bottom plate 47; the right sliding frame 43 is fixed on right side of the right vertical plate 46 through the fifth guiding rail 41; the second rack 44 is fixed on right side of the right vertical plate 46; the sixth servo motor 50 is fixed below the right sliding frame 43, and output end thereof is fixed with the second gear 45; the second gear 45 is meshed with the second rack 44; the third bearing seat 38 is fixed inside the right sliding frame 43 through the pin shaft 39; the third shaft 37 is mounted inside the third bearing seat 38 through a bearing; the fifth servo motor 49 is fixed on right side of the right sliding frame 43, and output end thereof is connected with right side of the pin shaft 39; the fourth servo motor 42 is fixed below the third bearing seat 38 through the transition plate 40, and output end thereof is connected with lower end of the third shaft 37; and the second roller 36 is fixed on the top of third shaft 37.

Synchronous clamping drive system includes that: the third gear 53 is fixed above the upper fixing plate 52; the left sliding plate 56 is fixed above the upper fixing plate 52 through the seventh guiding rail 55; the two left bearing seats 58 are fixed above the left sliding plate 56; each of the two left shafts 57 is fixed inside one of the left bearing seats 58 through a bearing; the right sliding plate 62 is mounted above the upper fixing plate 52 through the seventh guiding rail 55; the two right bearing seats 61 are fixed above the right sliding plate 62; each of the two right shafts 60 is mounted inside one of the right bearing seats 61 through a bearing; upper part of the two left shafts 57 and upper part of the two right shafts 60 are fixed with V-type rollers 59 respectively; the seventh servo motor 64 is fixed below the right sliding plate 62, and output end thereof is hinged with lower part of one of the right shafts 60; the clamping cylinder 63 is fixed on right side of the frame 1, and output end thereof is connected with the right sliding plate 62; and lower parts of the left sliding plate 56 and right sliding plate 62 are respectively fixed with one of the third racks 54 respectively, and two of the third racks 54 are meshed with the third gear 53 at the same time.

The first rolling system is mounted below left side of the frame 1 through the eighth guiding rail 66; and the fifth servo electric cylinder 65 is fixed on upper part of left side of the frame 1, and output end thereof is connected with the first rolling system.

Third rolling system includes that: the upper sliding plate 76 is mounted below right side of the frame 1 through eighth guiding rail 66; the sixth servo electric cylinder 67 is fixed on upper part of right side of the frame 1, and output end thereof is connected with the upper sliding plate 76; the upper vertical plate 74 is fixed below the upper sliding plate 76; the upper sliding frame 71 is fixed on right side of the upper vertical plate 74 through the ninth guiding rail 72; the fourth rack 73 is also fixed on right side of the upper vertical plate 74; the ninth servo motor 77 is fixed above the upper sliding frame 71, and output end thereof is fixed with the fourth gear 75; the fourth gear 75 is meshed with the fourth rack 73; the fourth bearing seat 68 is fixed on right side of the upper sliding frame 71; the fourth shaft 69 is mounted inside the fourth bearing seat 68 through a bearing; the eighth servo motor 70 is fixed inside the empty slot on right side of the upper sliding frame 71 and placed on left side of the fourth bearing seat 68, and output end thereof is connected with left side of the fourth shaft 69; the rotating frame 82 is fixed on right side of the fourth bearing seat 68; the fifth bearing seat 80 fixed above the rotating frame 82; the fifth shaft 79 is fixed inside the fifth bearing seat 80 through a bearing; the upper extrusion cutter 78 is fixed above the fifth shaft 79; the tenth servo motor 81 is fixed on lower end of upper part of the rotating frame 82, and output end thereof is connected with lower part of fifth shaft 79; the sixth bearing seat 84 is fixed on lower part of the rotating frame 82; the sixth shaft 85 is fixed inside the sixth bearing seat 84 through a bearing; the lower extrusion cutter 86 is fixed below the sixth shaft 85, and the eleventh servo motor 83 is fixed on the upper end of lower part of the rotating frame 82, and output end thereof is connected with upper part of the sixth shaft 85.

During operation, the clamping cylinder 63 makes the four V-type rollers 59 synchronously clamp the wheel through the third gear 53, the third rack 54 and the seventh guiding rail 55; the seventh servo motor 64 makes the clamped wheel rotate; the second servo electric cylinder 17 regulates the overturning plate 22 and the first roller 35 to an appropriate angle through the third guiding rail 18 and the connecting rod 21; the third servo motor 26 drives the first bevel gear 30 to rotate through the first shaft 28; the first bevel gear 30 drives the second shaft 34 and the first roller 35 to rotate by meshing with the second bevel gear 31; the lifting cylinder 2 initially lifts the first roller 35 to a certain height through the guiding pillars 87 and the guiding sleeves 88; the second servo motor 15 drives the first gear 13 to rotate, and accurately regulate the height of first roller 35 by meshing with the first rack 11; the first servo electric cylinder 16 may regulate the horizontal position of the first roller 35 through the first guiding rail 8; the third servo electric cylinder 23 makes the first roller 35 exert rolling pressure on rolled part through the fourth guiding rail 24; the first roller 35 may roll lower part of central hole, back cavity of spoke and inner rim of the wheel; at the same time, the first rolling system above may roll upper part of the central hole, upper rim and the like part of the wheel.

The sixth servo motor 50 regulates the second roller 36 to the appropriate height through the second gear 45, the second rack 44 and the fifth guiding rail 41; the fourth servo motor cylinder 51 regulates the horizontal position of the second roller 36 through the sixth guiding rail 48; the fourth servo motor 42 drives the second roller 36 to rotate through the third shaft 37; the fifth servo motor 49 arbitrarily regulates the angle of second roller 36 through the pin shaft 39; and the second roller 36 may achieve rolling on outer rim of the wheel.

The first servo motor 3 may make the first roller 35 and the second roller 36 rotate and exchange position through the supporting roller 6 and the rotating plate 7; the lower rim of the wheel may be rolled by regulating the first roller 35; the second roller 36 may roll flange root of the wheel.

The ninth servo motor 77 regulates the lower extrusion cutter 86 to an appropriate position through the fourth gear 75, the fourth rack 73 and the ninth guiding rail 72; with the rotation of the wheel, each bolt hole of the wheel may be extruded; the eighth servo motor 70 makes the rotating frame 82 rotate by a certain angle through fourth shaft 69, so that the axis of the upper extrusion cutter 78 is coaxial with the axis of the valve hole of the wheel; and by regulating the position of the upper extrusion cutter 78, the valve hole of the wheel may be extruded.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. Wheel rolling device, comprising: a frame, lifting cylinders, a first servo motor, a lower fixing plate, a lower lifting plate, supporting rollers, a rotating plate, a first guiding rail, a left bottom plate, a left vertical plate, a first rack, a second guiding rail, a first gear, a left vertical sliding plate, a second servo motor, a first servo electric cylinder, a second servo electric cylinder, a third guiding rail, a sliding block, a left transverse sliding plate, a connecting rod, a overturning plate, a third servo electric cylinder, a fourth guiding rail, an oblique sliding plate, a third servo motor, a left bracket, a first shaft, a first bearing seat, a first bevel gear, a second bevel gear, a transition block, a second bearing seat, a second shaft, a first roller, a second roller, a third shaft, a third bearing seat, a pin shaft, a transition plate, a fifth guiding rail, a fourth servo motor, a right sliding frame, a second rack, a second gear, a right vertical plate, a right bottom plate, a sixth guiding rail, a fifth servo motor, a sixth servo motor, a fourth servo electric cylinder, an upper fixing plate, a third gear, third racks, a seventh guiding rail, a left sliding plate, left shafts, left bearing seats, V-type rollers, right shafts, right bearing seats, a right sliding plate, a clamping cylinder, a seventh servo motor, a fifth servo electric cylinder, an eighth guiding rail, a sixth servo electric cylinder, a fourth bearing seat, a fourth shaft, an eighth servo motor, an upper sliding frame, a ninth guiding rail, a fourth rack, an upper vertical plate, a fourth gear, an upper sliding plate, a ninth servo motor, an upper extrusion cutter, a fifth shaft, a fifth bearing seat, a tenth servo motor, a rotating frame, a eleventh servo motor, a sixth bearing seat, a sixth shaft, a lower extrusion cutter, guiding pillars and guiding sleeves, lower lifting rotating system comprising: two of the lifting cylinders and four of the guiding sleeves are fixed on the lower fixing plate; output end of the lifting cylinder is hinged with lower part of the lower lifting plate, four of the guiding pillars matched with the guiding sleeves are also fixed below the lower lifting plate; the first servo motor is fixed below the lower lifting plate, and output end thereof is connected with the rotating plate; the supporting rollers are uniformly mounted in circumferential direction below the rotating plate; the first servo electric cylinder is fixed on left side above the rotating plate; the left bottom plate is fixed on left side above the rotating plate through the first guiding rail; output end of the first servo electric cylinder is connected with the left bottom plate; the fourth servo electric cylinder is fixed on right side above the rotating plate; the right bottom plate is fixed on right side above the rotating plate through the sixth guiding rail; and output end of the fourth servo electric cylinder is connected with the right bottom plate;

first rolling system comprising: the left vertical plate is fixed above the left bottom plate; the left vertical sliding plate is fixed on left side of the left vertical plate through the second guiding rail; the first rack is fixed on left side of the left vertical plate; the second servo motor is fixed on left side of the left vertical sliding plate, and output end thereof is fixed with the first gear; the first gear engages with the first rack; the left transverse sliding plate is fixed above the left vertical sliding plate; the sliding block is mounted above the left transverse sliding plate through the third guiding rail; the second servo electric cylinder is fixed on right side of the left transverse sliding plate, and output end thereof is connected with right side of the sliding block; lower part of the overturning plate is hinged with left side of the left transverse sliding plate; two ends of the connecting rod are hinged with the overturning plate and the sliding block, respectively; the oblique sliding plate is fixed above the overturning plate through the fourth guiding rail; the third servo electric cylinder is fixed above the overturning plate, output end thereof is connected with the oblique sliding plate; the left bracket is fixed above the oblique sliding plate; the first bearing seat is fixed above the left bracket; the first shaft is mounted inside the first bearing seat through a bearing; the third servo motor is fixed below the left bracket, and output end thereof is connected with lower part of the first shaft; the transition block is fixed above the first bearing seat; and the second bearing seat is fixed above the transition block; the second shaft is mounted inside the second bearing seat through a bearing; the first roller is fixed above the second shaft, and the second bevel gear is fixed below the second shaft; and the second bevel gear is meshed with the first bevel gear, the present device includes two sets of the first rolling system which are positioned above and below respectively;

second rolling system comprising: the right vertical plate is fixed above the right bottom plate; the right sliding frame is fixed on right side of the right vertical plate through the fifth guiding rail; the second rack is fixed on right side of the right vertical plate; the sixth servo motor is fixed below the right sliding frame, and output end thereof is fixed with the second gear; the second gear is meshed with the second rack; the third bearing seat is fixed inside the right sliding frame through the pin shaft; the third shaft is mounted inside the third bearing seat through a bearing; the fifth servo motor is fixed on right side of the right sliding frame, and output end thereof is connected with right side of the pin shaft; the fourth servo motor is fixed below the third bearing seat through the transition plate, and output end thereof is connected with lower end of the third shaft; and the second roller is fixed on the top of third shaft;

synchronous clamping drive system comprising: the third gear is fixed above the upper fixing plate; the left sliding plate is fixed above the upper fixing plate through the seventh guiding rail; the two left bearing seats are fixed above the left sliding plate; each of the two left shafts is fixed inside one of the left bearing seats through a bearing; the right sliding plate is mounted above the upper fixing plate through the seventh guiding rail; the two right bearing seats are fixed above the right sliding plate; each of the two right shafts are mounted inside one of the right bearing seats through a bearing; upper part of the two left shafts and upper part of the two right shafts are fixed with V-type rollers respectively; the seventh servo motor is fixed below the right sliding plate, and output end thereof is hinged with lower part of one of the right shafts; the clamping cylinder is fixed on right side of the frame, and output end thereof is connected with the right sliding plate; and lower parts of the left sliding plate and right sliding plate are respectively fixed with one of the third racks respectively, and two of the third racks are meshed with the third gear at the same time;

the first rolling system is mounted below left side of the frame through the eighth guiding rail; and the fifth servo electric cylinder is fixed on upper part of left side of the frame, and output end thereof is connected with the first rolling system;

third rolling system comprising: the upper sliding plate is mounted below right side of the frame through eighth guiding rail; the sixth servo electric cylinder is fixed on upper part of right side of the frame, and output end thereof is connected with the upper sliding plate; the upper vertical plate is fixed below the upper sliding plate; the upper sliding frame is fixed on right side of the upper vertical plate through the ninth guiding rail; the fourth rack is also fixed on right side of the upper vertical plate; the ninth servo motor is fixed above the upper sliding frame, and output end thereof is fixed with the fourth gear; the fourth gear is meshed with the fourth rack; the fourth bearing seat is fixed on right side of the upper sliding frame; the fourth shaft is mounted inside the fourth bearing seat through a bearing; the eighth servo motor is fixed inside the empty slot on right side of the upper sliding frame and placed on left side of the fourth bearing seat, and output end thereof is connected with left side of the fourth shaft; the rotating frame is fixed on right side of the fourth bearing seat; the fifth bearing seat fixed above the rotating frame; the fifth shaft is fixed inside the fifth bearing seat through a bearing; the upper extrusion cutter is fixed above the fifth shaft; the tenth servo motor is fixed on lower end of upper part of the rotating frame, and output end thereof is connected with lower part of fifth shaft; the sixth bearing seat is fixed on lower part of the rotating frame; the sixth shaft is fixed inside the sixth bearing seat through a bearing; the lower extrusion cutter is fixed below the sixth shaft, and the eleventh servo motor is fixed on the upper end of lower part of the rotating frame, and output end thereof is connected with upper part of the sixth shaft.

* * * * *